US007319209B2

(12) United States Patent
Francis et al.

(10) Patent No.: US 7,319,209 B2
(45) Date of Patent: Jan. 15, 2008

(54) COOKER CONTROL MECHANISM

(75) Inventors: Mark Francis, Nottingham (GB); David Fisher, Middlesex (GB)

(73) Assignee: Lincat Group plc, Lincoln (GB)

( * ) Notice: Subject to any disclaimer, the term of this patent is extended or adjusted under 35 U.S.C. 154(b) by 0 days.

(21) Appl. No.: 11/592,752

(22) Filed: Nov. 2, 2006

(65) Prior Publication Data

US 2007/0102417 A1 May 10, 2007

(30) Foreign Application Priority Data

Nov. 3, 2005 (GB) ..... 0522420.9

(51) Int. Cl.
*H05B 1/02* (2006.01)

(52) U.S. Cl. ..... 219/482; 219/494; 219/508; 219/414; 219/445.1

(58) Field of Classification Search ..... 219/412–415, 219/445.1, 506, 490, 491, 494, 493, 497, 219/499, 507, 482; 99/325–337
See application file for complete search history.

(56) References Cited

U.S. PATENT DOCUMENTS 1,643,176 A 9/1927 Roy
2,134,029 A 10/1938 Chambers
3,035,567 A 5/1962 Reeves

FOREIGN PATENT DOCUMENTS

| | | |
|---|---|---|
| DE | 11 10 276 B | 7/1961 |
| FR | 2 164 403 | 7/1973 |
| GB | 1 493 487 A | 11/1977 |
| GB | 2 410 541 A | 8/2005 |
| JP | 55-146336 A | 11/1980 |
| JP | 60-138330 | 7/1985 |

OTHER PUBLICATIONS

British Search Report, dated Mar. 10, 2006, corresponding to Priority British Appln. No. GB0522420.9.
Patent Abstracts of Japan, Publication No. 60-138330, dated Jul. 23, 1985, in the name of Matsumoto.
European Search Report dated Jan. 11, 2007, For European application 06123114.8-2313, in the name of Lincat Group plc corresponding to British priority 0522420.9, 5 pages.

*Primary Examiner*—Mark Paschall
(74) *Attorney, Agent, or Firm*—Christie, Parker & Hale, LLP

(57) ABSTRACT

A manual control mechanism for a heating unit of a domestic cooker (1) having a front face is in the form of a twist grip (11, 12, 13) operable by rotation about a substantially horizontal axis parallel to the front face of the cooker. A plurality of such control mechanisms are provided in a rail (7) mounted on the front of the cooker.

12 Claims, 9 Drawing Sheets

COOKER CONTROL MECHANISM

CROSS-REFERENCE TO RELATED APPLICATION

This application claims priority of British Patent Application Number 0522420.9, filed on Nov. 3, 2005.

The invention relates to a manual control mechanism for a heating unit, such as a gas or electric ring or plate of a domestic cooker.

Such mechanisms are usually provided by manually rotatable knobs mounted on the front face or top of the cooker. When mounted on the front face, the knobs are rotatable about an axis perpendicular to the front face. The control panel in this case may be vertical so that the axis of the control knobs is horizontal or, may be inclined so that the axis of the control knobs is correspondingly inclined. In the case of knobs mounted on the top of the cooker, the knobs are rotatable about a substantially vertical axis.

The invention provides a control mechanism that is operable by rotation about a substantially horizontal axis parallel to the front face of the cooker.

In a particular embodiment a plurality of axially aligned control mechanisms are formed in a cylindrical rail which is mounted on the front of the cooker as a towel rail.

In another aspect, the invention provides a towel rail for mounting on the front of a cooker and incorporating a hanging element for a towel or the like which is axially movable between a recessed storage position within the rail and an exposed position for use.

In another aspect, the invention provides a towel rail mounted on the front of a domestic cooker having a friction strip mounted thereon to help maintain a towel or the like on the rail.

Embodiments of the invention are described below with reference to the accompanying drawings, in which.

Figure 1:
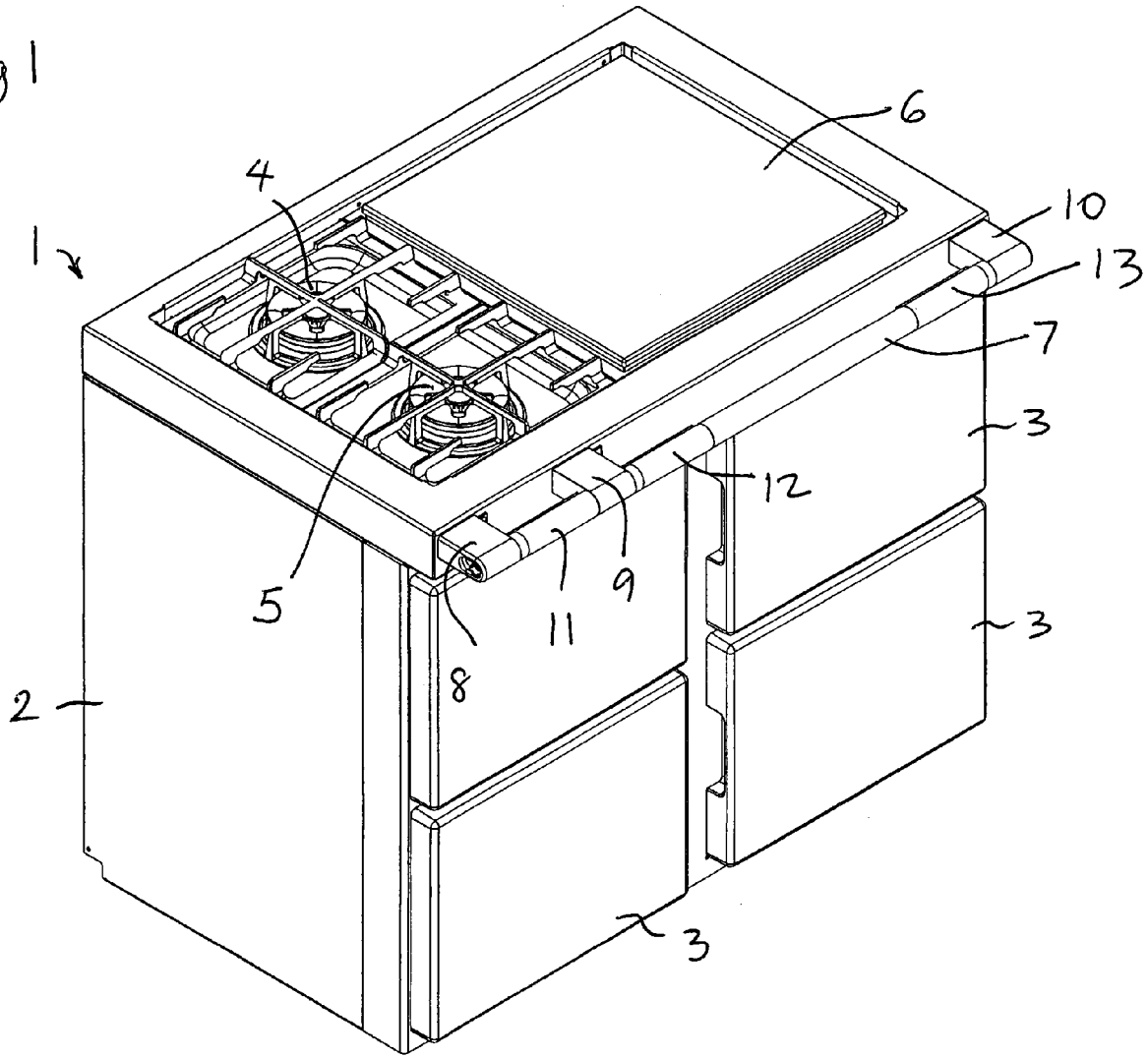
FIG. 1 is a perspective view of a domestic cooker.
Figure 2:
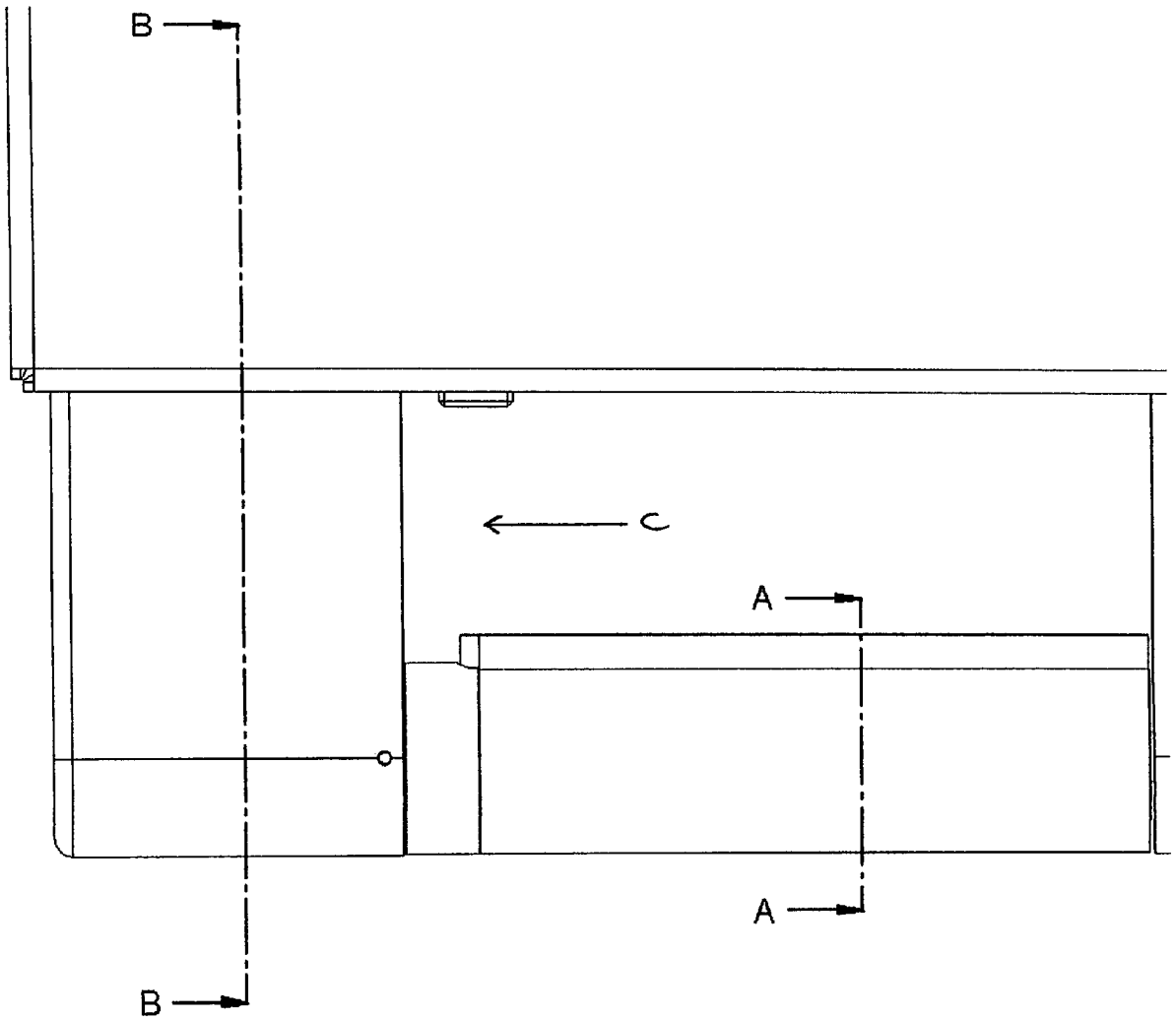
FIG. 2 is a plan view showing part of a rail mounted on the front of the cooker.

The domestic cooker 1 shown in FIG. 1 has a frame 2 which supports four heating/cooking compartments closed by hinged doors 3. The top of the cooker is provided with three heating units in the form of two gas rings 4, 5 and an electric hot plate 6. A cylindrical rail 7 is mounted on the front of the cooker by three housing blocks 8, 9, 10. The rail 7 incorporates three manual control mechanisms 11, 12, 13 for respectively controlling the heating units 4, 5 and 6.

Each of the control mechanisms comprises a tubular twist grip which is operable by rotation about the axis of the rail which is a substantially horizontal axis parallel to and spaced from the front face of the cooker. The control members are axially aligned along the rail.

Figure 3:
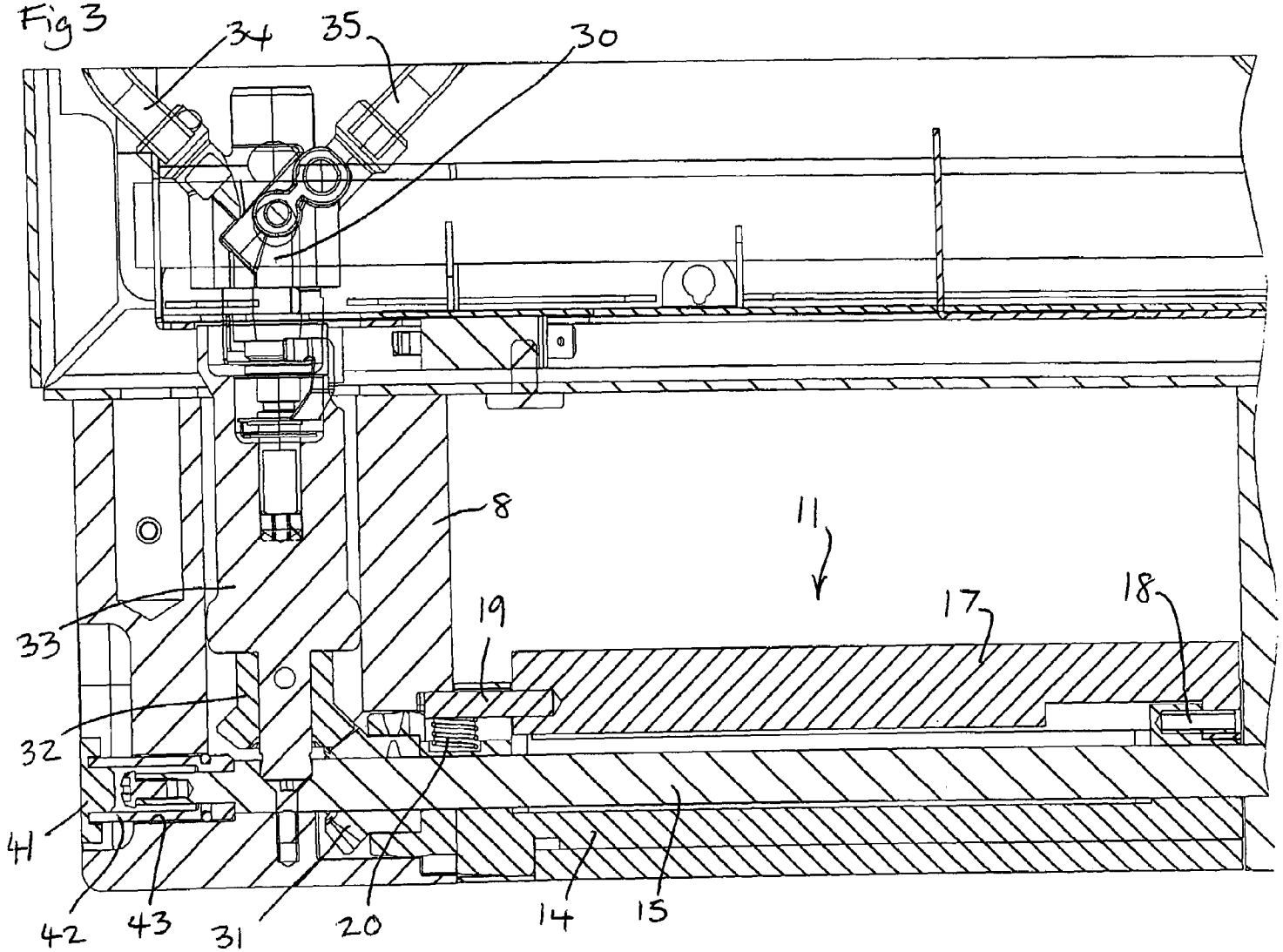
FIG. 3 is a horizontal section taken through the part of the rail and the front part of the cooker shown in FIG. 2.
Figure 4:
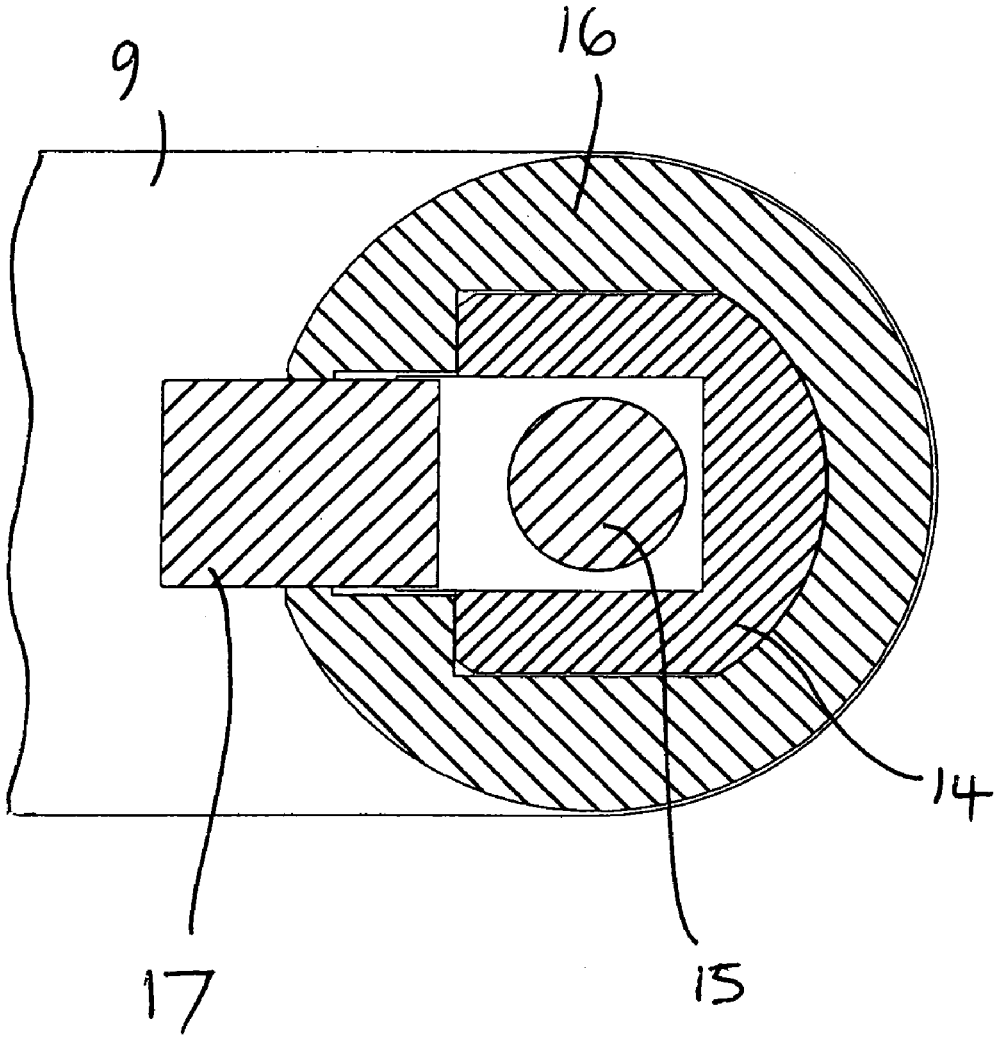
FIG. 4 is a vertical cross-section taken on the line A-A of FIG. 2.
Figure 6:
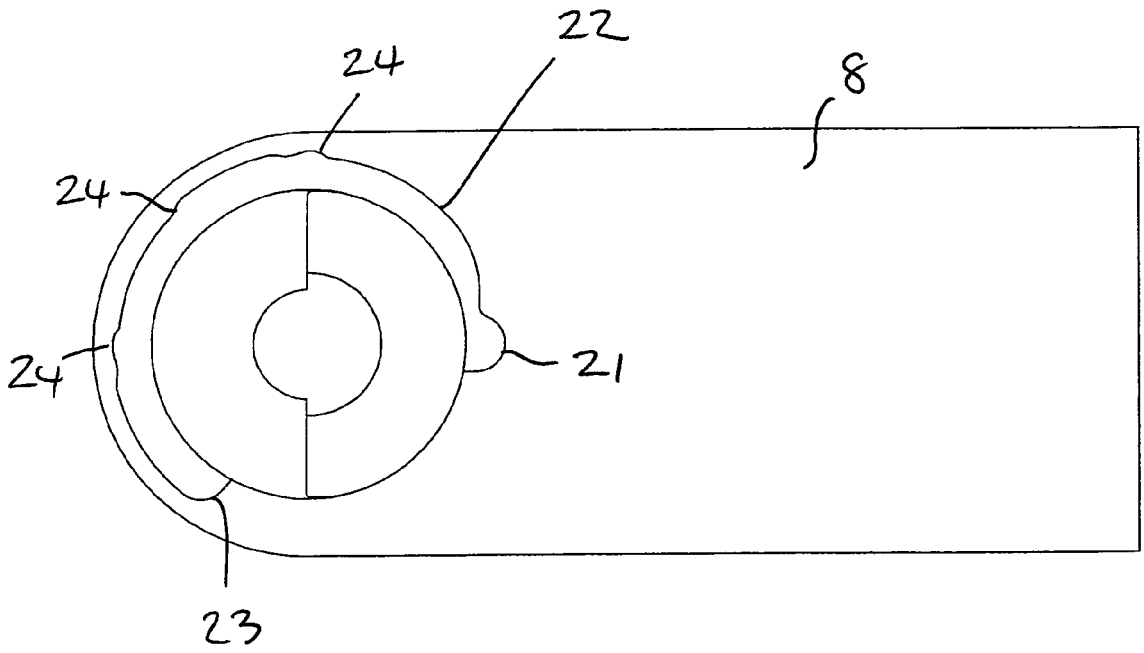
FIG. 6 is an elevation view of a housing block taken in the direction C in FIG. 2.

As best seen in FIGS. 3 and 4, the twist grip control mechanism comprises an elongate inner member 14 which is rotatably mounted about its central axis on a spindle 15 which extends along the length of the rail 7. The inner member 14 only engages the spindle towards each of its ends and this helps to avoid jamming. An outer sleeve 16, which may be formed of a rubber, or plastic material is mounted fixedly on the inner member and has an elongate opening or slot therein to receive a latching member 17 which extends through the sleeve to be manually engaged by the user when the twist grip is gripped. The latching member 17 is pivotally mounted on the inner member 14 by a fixing pin 18 which is a tight fit in the inner member and a slack fit in the latching member. At the opposite end of the pin 18 the latching member carries a locking pin 19 which is engaged by a spring 20 to bias the pin 19 and thus the latching member 17 to its outer pivotal position shown in the figures. In this outer position, the pin 19 is held in a notch 21 in a cam track 22 seen best in FIG. 6. This is the "off" position of the twist grip and rotation of the twist grip is prevented by virtue of engagement of the pin 19 in the notch 21.

In operation, the twist grip 11 is grasped manually by the user and this causes the latching member to be moved pivotally against the action of the resilient bias of the spring 20. This movement of the latching member releases the pin 19 from the notch 21 and permits rotation of the twist grip with the pin following along the inside surface of the cam track 22 between the notch 21 and an end stop 23. Various detents 24 may be provided along the cam track 22 to indicate to the user different stages of operation but these do not prevent rotation of the twist grip in the manner of the notch 21.

Figure 5:
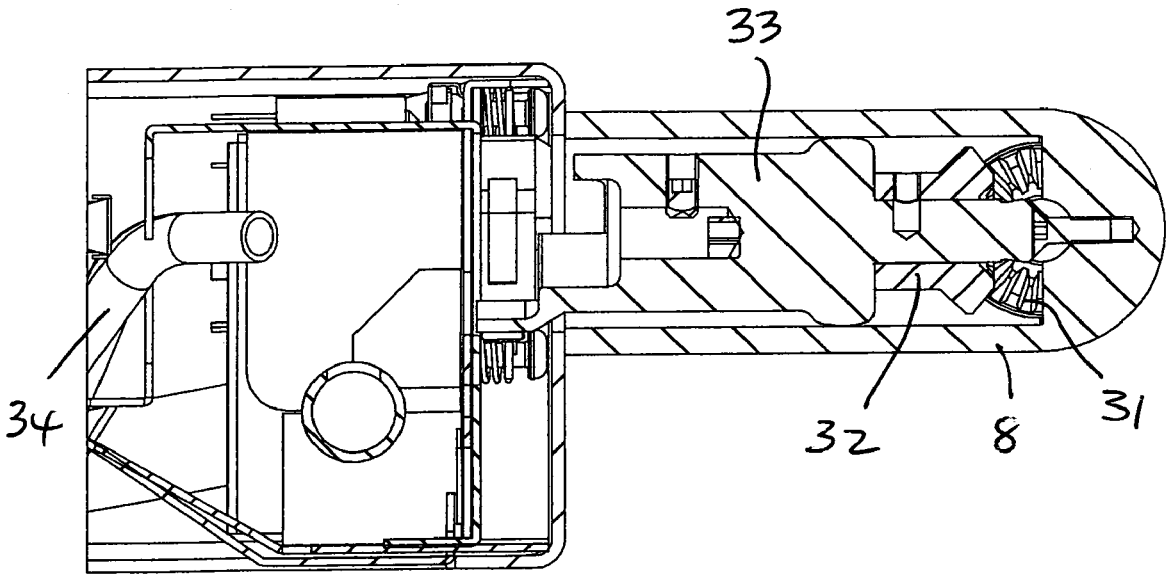
FIG. 5 is a vertical cross-section taken on the line B-B of FIG. 2.

In the example shown, the control mechanism 11 operates a control valve 30 (not shown in FIG. 5) for the supply of gas to the gas ring 4. A bevel gear 31 fixed to the inner member 14 meshes with a bevel gear 32 fixed to a valve connector 33 journalled in the block 8 and coupled to the valve 30. Thus, rotation of the twist grip causes rotation of the spindle of the valve 30 which controls the supply of gas from a main supply valve to gas pipes 34, 35 leading to the gas ring 4.

In the example described, the twist grip 13 controls the supply of power to an electric hot plate 6. In this case, rotation of the twist grip will operate an electric control mechanism (not shown) for the hot plate. Any combination of electric and gas heating units can be provided as required and indeed, more or fewer control mechanisms can be provided according to the number of heating units to be operated.

Figure 7:
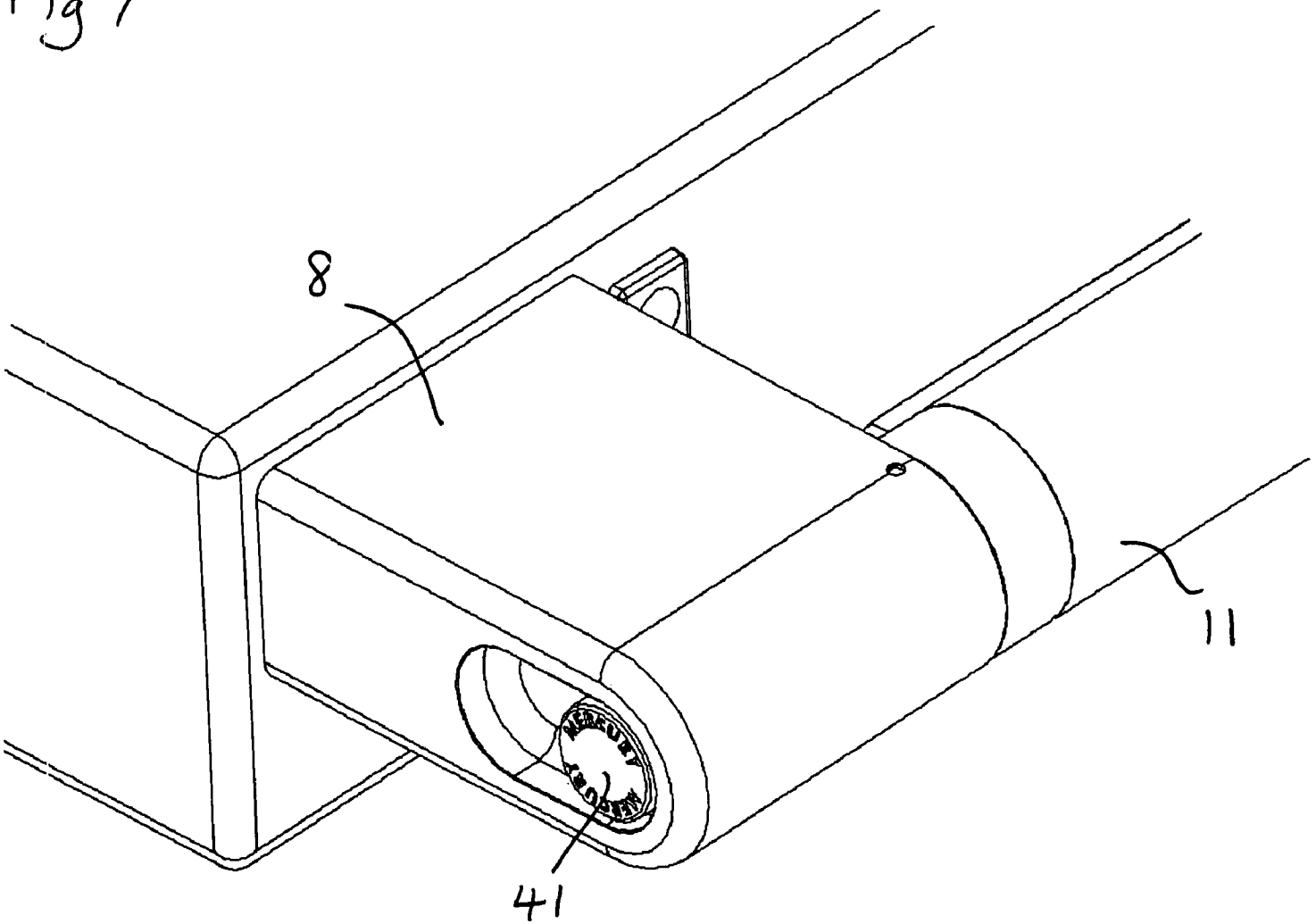
FIG. 7 is an enlarged fragmentary view showing a hanging element in a storage position.
Figure 8:
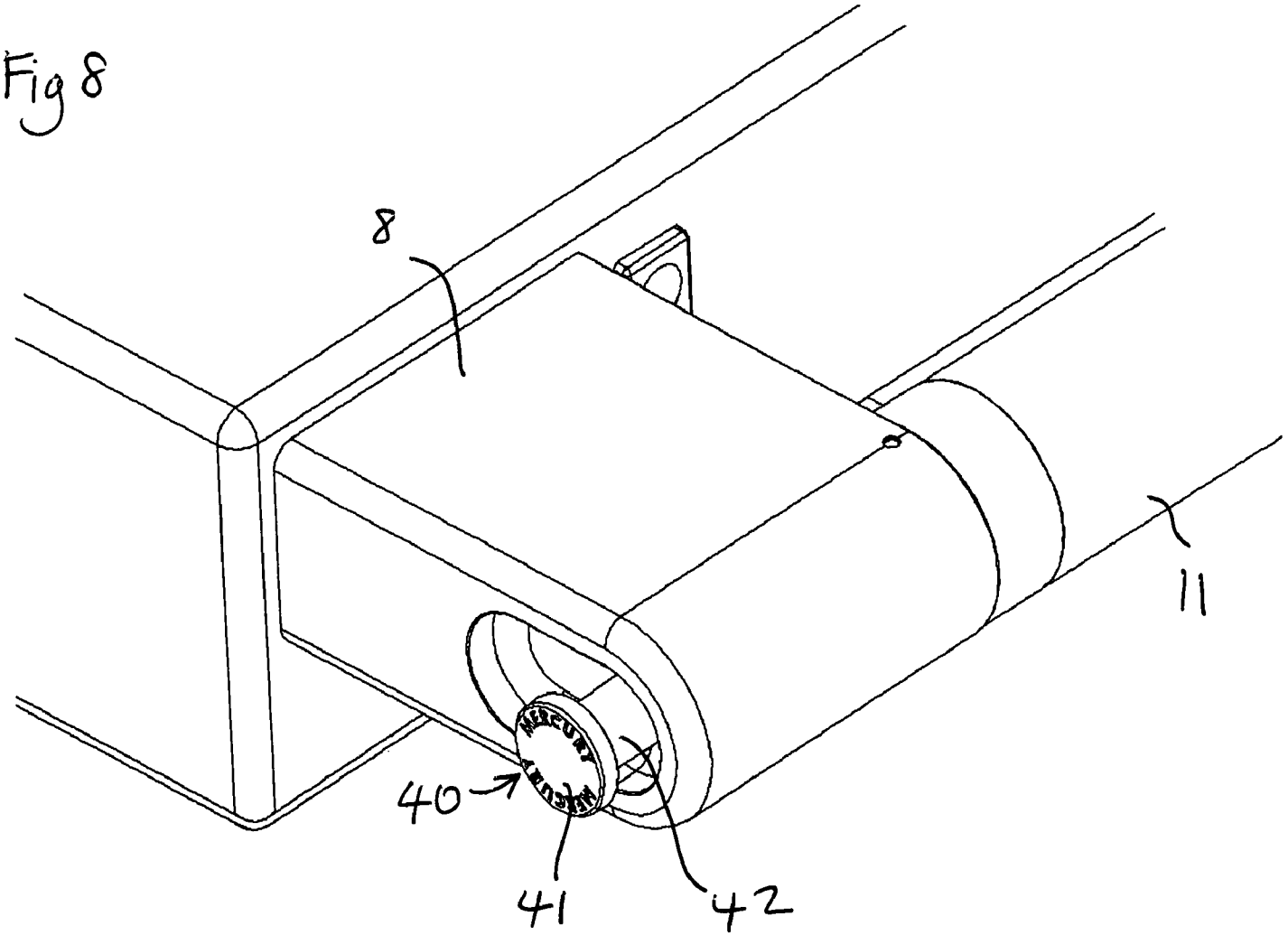
FIG. 8 is an enlarged fragmentary view showing the hanging element in an exposed position for use.

A hanging element 40 for a towel or the like is shown in FIGS. 3, 7 and 8. The hanging element comprises a knob 41 mounted on the outer end of a cylindrical piston 42 which is axially slidable in a bore 43 formed at one end of the towel rail between a recessed storage position shown in FIGS. 3 and 7 and an exposed position for use shown in FIG. 8.

Figure 9:
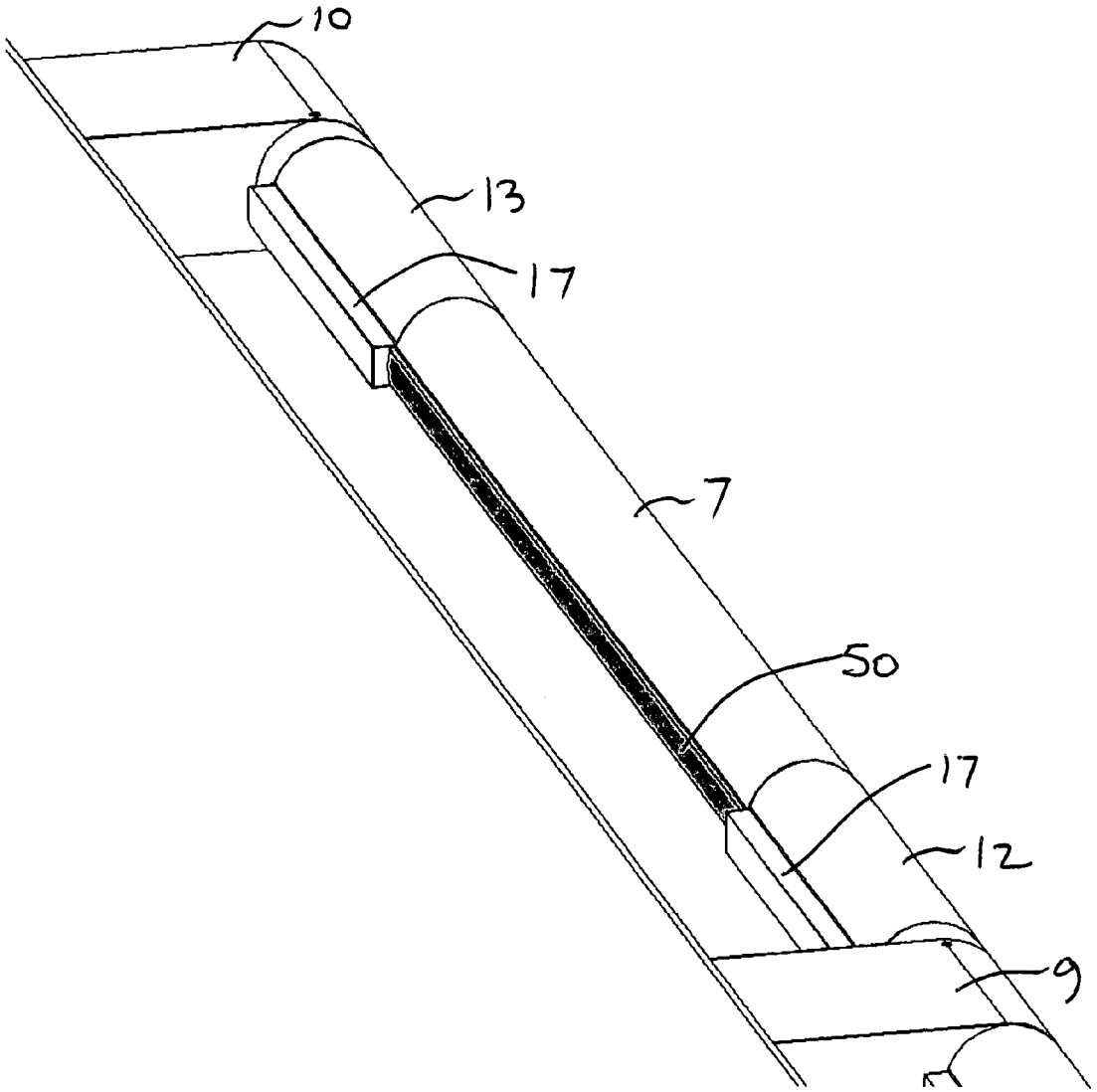
FIG. 9 is a fragmentary view showing a part of the rail from above and behind.

An elongate rubber friction strip 50, shown in FIG. 9, is mounted at the back of the rail 7 between the twist grips 12 and 13. The friction strip 50 helps to maintain a towel or the like on the rail.

The invention claimed is:

1. A manual control mechanism for a heating unit of a domestic cooker having a front face, wherein the control mechanism is operable by rotation about a substantially horizontal axis parallel to the front face of the cooker;

wherein the control mechanism comprises a tubular twist grip rotatably movable from an off position to one or more on positions; and wherein the twist grip includes a latching member which is resiliently biased towards a position in which it prevents operation of the twist grip from its off position but permits such operation when moved against the action of the resilient bias.

2. A manual control mechanism as claimed in claim 1, wherein the twist grip comprises an elongate inner member rotatably mounted about its central axis and an outer sleeve mounted fixedly on the inner member; wherein the latching member is pivotally mounted on the inner member and extends through the outer sleeve to be manually engaged by the user.

3. A manual control mechanism as claimed in claim 1, in which the latching member is biased toward an outer pivotal position in which, in the off position of the twist grip, it prevents rotation of the twist grip away from its off position but permits such rotation when moved against the biasing means to an inner pivotal position.

4. A manual control mechanism as claimed in claim 1, wherein rotation of the twist grip operates a control valve for the supply of gas to a heating unit.

5. A manual control mechanism as claimed in claim 1, wherein rotation of the twist grip operates a control device for the supply of power to an electric heating unit.

6. A manual control mechanism as claimed in claim 1 formed as part of a cylindrical rail mounted on the front of the cooker.

7. A manual control mechanism for a heating unit of a domestic cooker having a front face;

wherein the control mechanism is operable by rotation about a substantially horizontal axis parallel to the front face of the cooker;

wherein the control mechanism is formed as part of a cylindrical rail mounted on the front of the cooker; and wherein the cylindrical rail is formed with a plurality of axially aligned control mechanisms.

8. A domestic cooker having a plurality of heating units in the form of heating rings or plates and having a front face and incorporating at least one control mechanism for controlling the supply of gas or electric power to one of the heating units and operable by rotation about a substantially horizontal axis parallel to the front face of the cooler;

wherein the control mechanism comprises a tubular twist grip movable from an off position to one or more on positions and formed as part of a cylindrical rail mounted in front of the front face of the cooker.

9. A domestic cooker as claimed in claim 8, wherein the twist grip includes a latching member which is resiliently biased towards a position in which it prevents operation of the twist grip from its off position but permits such operation when moved against the action of the resilient base.

10. A domestic cooker as claimed in claim 9, wherein the twist grip comprises an elongate inner member rotatably mounted about its central axis and an outer sleeve mounted fixedly on the inner member; wherein the latching member is pivotally mounted on the inner member and extends through the outer sleeve to be manually engaged by the user.

11. A domestic cooker as claimed in claim 9, wherein the latching member is biased towards an outer pivotal position in which, in the off position of the twist grip, it prevents rotation of the twist grip away from its off position but permits such rotation when moved against the biasing means to an inner pivotal position.

12. A domestic cooker as claimed in claim 8, wherein the cylindrical rail is formed with a plurality of axially aligned control mechanisms.

* * * * *